US007748512B2

(12) United States Patent
Geiger

(10) Patent No.: US 7,748,512 B2
(45) Date of Patent: Jul. 6, 2010

(54) LOCK FOR COIN DEPOSIT CONTAINER

(75) Inventor: Diethard Geiger, Velbert (DE)

(73) Assignee: Schulte-Schlagbaum Aktiengesellschaft (DE)

( * ) Notice: Subject to any disclaimer, the term of this patent is extended or adjusted under 35 U.S.C. 154(b) by 0 days.

(21) Appl. No.: 12/263,833

(22) Filed: Nov. 3, 2008

(65) Prior Publication Data

US 2009/0113951 A1 May 7, 2009

(30) Foreign Application Priority Data

Oct. 29, 2007 (DE) ..... 10 2007 052 583

(51) Int. Cl.
*G07F 5/00* (2006.01)
*G07F 5/02* (2006.01)

(52) U.S. Cl. ..... 194/293; 194/247; 194/290

(58) Field of Classification Search ..... 194/247, 194/290, 293, 905, 259, 282, 285, 292, 352; 70/57, DIG. 17, DIG. 41
See application file for complete search history.

(56) References Cited

U.S. PATENT DOCUMENTS 1,633,411 A * 6/1927 Kassler ..... 194/298
2,034,359 A * 3/1936 Segal ..... 194/294
2007/0187208 A1* 8/2007 Tsai ..... 194/205

FOREIGN PATENT DOCUMENTS

| | | | |
|---|---|---|---|
| DE | 19515765 | A1 | 10/1996 |
| DE | 19527066 | A1 | 1/1997 |
| DE | 19832516 | A1 | 1/2000 |
| DE | 102006034292 | A1 | 1/2008 |
| DE | 10350951 | B4 | 2/2008 |

* cited by examiner

*Primary Examiner*—Patrick Mackey
*Assistant Examiner*—Mark Beauchaine
(74) *Attorney, Agent, or Firm*—St. Onge Steward Johnston & Reens LLC

(57) ABSTRACT

A container lock with a housing and, positioned in it, a bolt that can be displaced by actuating a handle, with an insertion shaft for inserting a coin, with a scanning device for scanning the diameter of the coin inserted into the insertion shaft as far as a scanning position, where the scanning device interacts with a blocking device in such a way that the bolt can be displaced only with a coin having a correct diameter. It is proposed that the scanning device should configure a fixing jaw, which securely grips the coin that is inserted in the insertion shaft so that it is partly accessible from outside in the scanning position with the bolt pre-locked to prevent its withdrawal.

16 Claims, 7 Drawing Sheets

LOCK FOR COIN DEPOSIT CONTAINER

FIELD OF THE INVENTION

The invention relates to a container lock with a housing and within it a bolt that can be displaced by actuating a handle, as well as with an insertion shaft for inserting a coin, with a scanning device for scanning the diameter of the coin inserted in the insertion shaft as far as a scanning position, so that the scanning device interacts with a blocking device in such a way that the bolt can be displaced only for a coin having a correct diameter.

BACKGROUND OF THE INVENTION

A container lock of this type is known in the art from DE 109 32 516 A1. The previously known lock for a locking installation includes a housing, a bolt that can be displaced within the housing by a handle, so that the bolt is held in its reclosed position by means of a blocking device. Said blocking device is released to pre-lock the bolt when a coin having a correct diameter is inserted in an insertion shaft. The lock comprises a scanning device for scanning the diameter of the coin. If the lock is reclosed again by actuation of a handle, the coin falls into a return shaft.

DE 10 2006 034 292 discloses a container lock in which a secret code must be entered in a lock to reclose the bolt. The secret code can be entered by a keyboard. The lock is also capable of reading a transponder in which the secret code is stored.

DE 195 15 765 A1 discloses a coin deposit lock that is used for supermarket carts. The lock comprises an insertion shaft. The unlocking mechanism is released by inserting the coin.

It is the object of the invention to improve a generic container lock for advantageous functioning.

SUMMARY OF THE INVENTION

The object is fulfilled through the invention as indicated in the claims, wherein every claim constitutes an independent solution of the object of the invention and can be combined with every other claim.

It is proposed, first and essentially, that the scanning device should be configured as a fixing jaw that firmly prevents the coin that is entering the insertion shaft in the scanning position while still partially accessible from outside from being withdrawn with the bolt pre-locked. According to the invention the coin is inserted into the insertion shaft of the lock housing as far as the scanning position. In this scanning position the scanning device scans the diameter of the coin. The position here is a maximum insertion depth in which the coin can still be gripped from outside but, because of the fixing function of the fixing jaw, cannot be withdrawn from the insertion shaft. The coin is preferably held in a form-locking mounting in the scanning position. The coin is thus preferably partially surrounded as if by a pincer, so that a fixing jaw is configured by an oscillating lever that can rotate around an axle in the housing. An additional fixing jaw can be combined firmly with the housing. The two fixing jaws surround the coin beyond its area of maximum diameter, so that it can be withdrawn again only from the insertion shaft after a separating motion of the two fixing jaws. No actuation of the bolt occurs with the coin itself. Said bolt can preferably be displaced perpendicularly to the coin-inserting direction. The oscillating lever preferably comprises a support arm, on whose ends the axle is fulcrumed. The fixing jaw preferably extends down from the supporting limb in an essentially perpendicular direction. The oscillating lever forms a rotation recess flanked by at least one blocking flank. A rotation stud attached to the bolt can engage in this rotation recess when an appropriate coin is inserted into the insertion shaft. A guide groove can connect with the rotation recess. Said guide groove extends, when an appropriate coin is inserted, in a direction essentially parallel to the displacement direction of the bolt. While the movable fixing jaw extends essentially perpendicular to the displacement direction of the bolt, the supporting limb extends parallel to the displacement direction of the bolt. The stationary fixing jaw can become movable. It can be secured to the lock housing, for instance by means of screws. By releasing the screws, the distance between the fixing jaws can be adjusted in the release position. The insertion shaft preferably comprises a convexity in which a portion of the inserted coin is located. The convexity extends over a surface that is large enough so that the coin can be grasped between two fingers to allow it to be extracted from the insertion shaft. Essentially the coin is inserted into the insertion shaft only for scanning its diameter. While the coin is being inserted, only the blocking device is displaced from a blocking position into a release position. No bolt displacement is possible by means of the coin. In an elaboration of the invention, the lock housing comprises a blocking element. Said blocking element is accessible from the housing exterior. Said blocking element is capable of fixing the oscillating lever or the rotation recess in a position in which the rotation recess lies in the path of the rotation stud. Thus, when blocked, the lock can be actuated without deposit function. The blocking element can take the form of a blocking stud, which in blocked position engages in an end portion of the guide groove that connects with the rotation recess, in order to make the oscillating lever stationary in the rotation position corresponding to the release position. The bolt pre-locking occurs in known manner by means of a crankshaft, which is actuated by a handle. Said crankshaft engages in an engagement opening of the bolt in order to pre-lock the bolt. The lock, in addition, comprises a blocking device with which the bolt can be kept in the pre-closed position. The blocking device, in addition, can also hold the bolt in the re-locked position. The blocking device can be brought from a blocked position into a release position. This can occur in known manner, for instance by actuating a key. However, the blocking device is preferably released by reading an electronic secret code, and the secret code is kept in a transponder, which in known manner is read by the closing device. In addition it can be foreseen that the secret code is a PIN, which is entered by a keyboard. In addition, the lock can comprise a fingerprint reading device in order to read a user's fingerprint. Upon correctly entering the secret code, the blocking device is displaced into the release position. The bolt can be pre-locked. The blocking device holds it in the pre-locked position until the correct secret code is again entered. The lock can include a cashier function. For this purpose the lock can be opened with an overriding secret code. In the re-closed bolt position, the coin can be withdrawn. By means of an auxiliary tool that is inserted into the insertion shaft, the two jaws are moved apart to the correct distance, so that the rotation stud can engage in the rotation recess. The fixing jaw can be temporarily blocked in this position by means of the blocking device. It is foreseen that, when the bolt is completely pre-locked, the rotation stud can move the blocking device out of the blocked position. This can occur by pressure on the blocking pin. Said blocking pin is then moved out of the guide groove. The oscillating lever can also be made stationary by means of a screw. For this purpose the oscillating lever, and in particular the fixing jaw formed by the oscillating lever, can configure a screw-in opening into which the screw can be inserted and turned. As a result, the scanning device can be put out of operation for an extended period so that the lock can also be operated without deposit function. In an elaboration of the invention it is foreseen that the scanning device interacts with an electric scanner or a switch. Depending on the actuation position of the scanning device, an electric circuit is closed or opened. As a result an electric signal can be provided, which changes its condition when an appropriate coin is inserted into the insertion shaft. This electric signal can be used to block or release the bolt. For this purpose it is possible to use an electric magnet that can be already situated in the lock housing. Said magnet can be moved into a release position when the scanning device emits a corresponding electric signal. In an elaboration of the invention it is foreseen that the coin diameter is immediately scanned by a scanner.

An embodiment of the invention is explained hereafter with reference to appended illustrations.

DETAILED DESCRIPTION OF THE INVENTION

Figure 1:
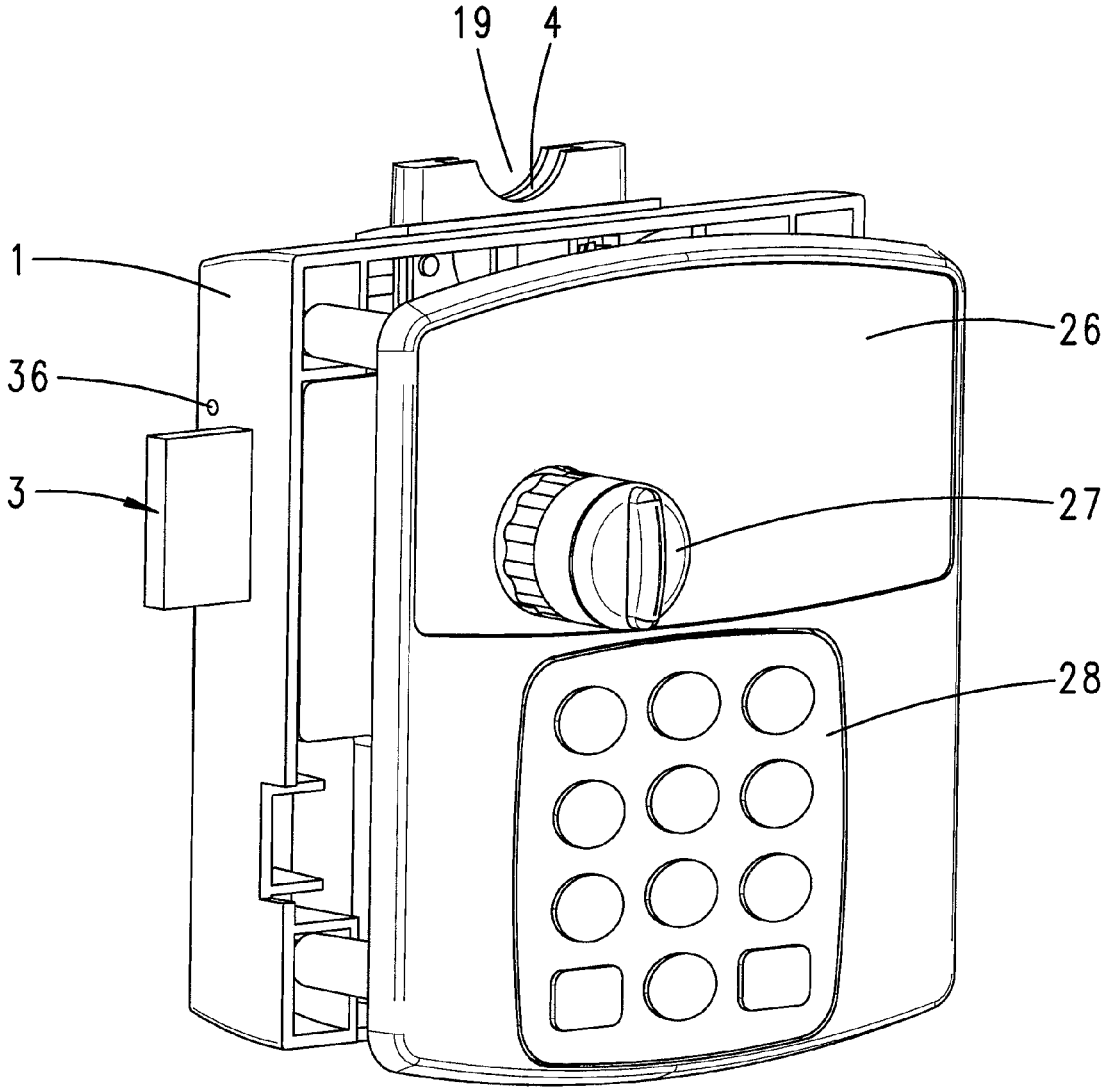
FIG. 1 shows the housing in perspective frontal view as well as the front plate of a container lock in a perspective depiction.
Figure 2:
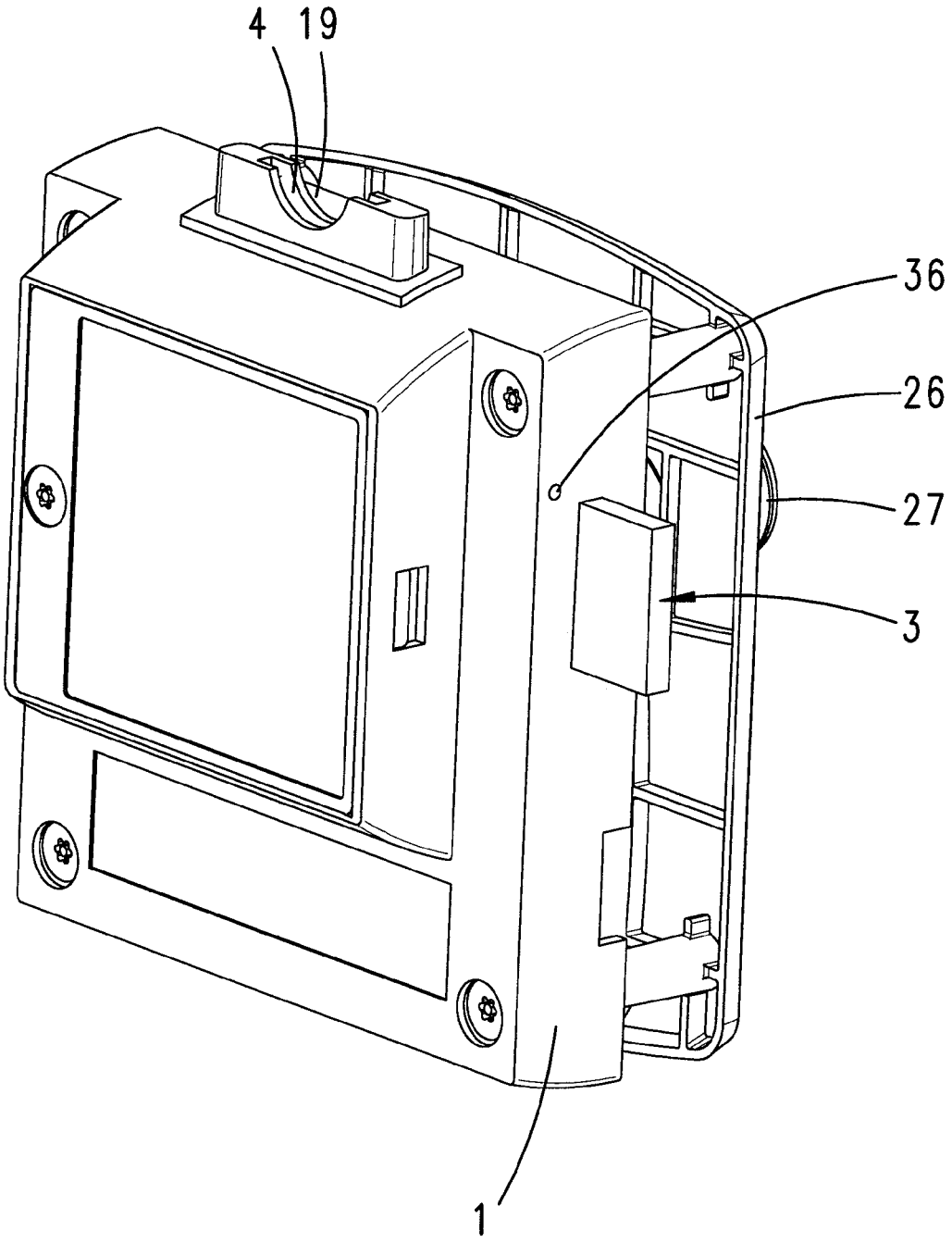
FIG. 2 is a backward perspective depiction of the container lock.
Figure 3:
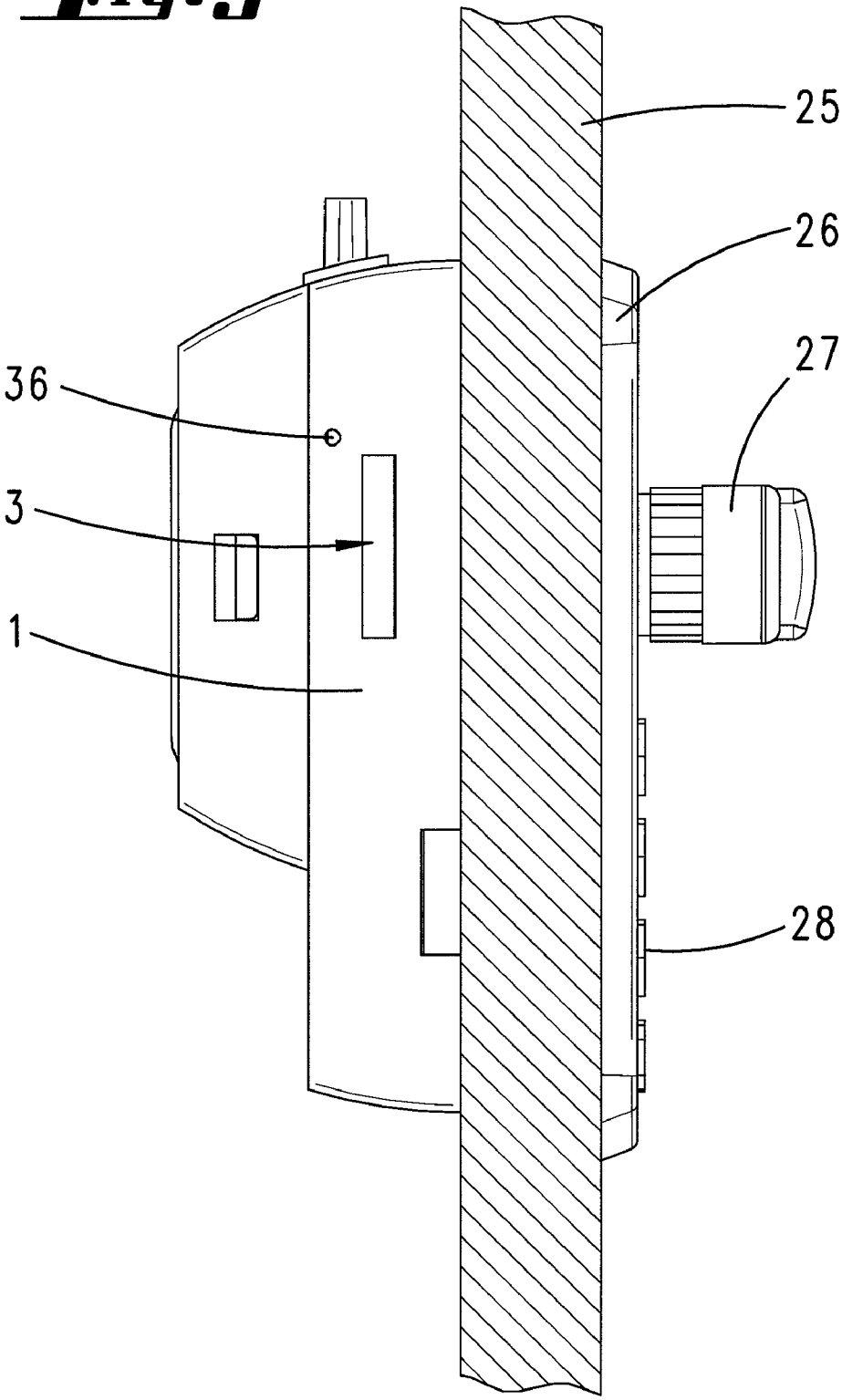
FIG. 3 shows a front view of the lock with the lock door indicated.
Figure 4:
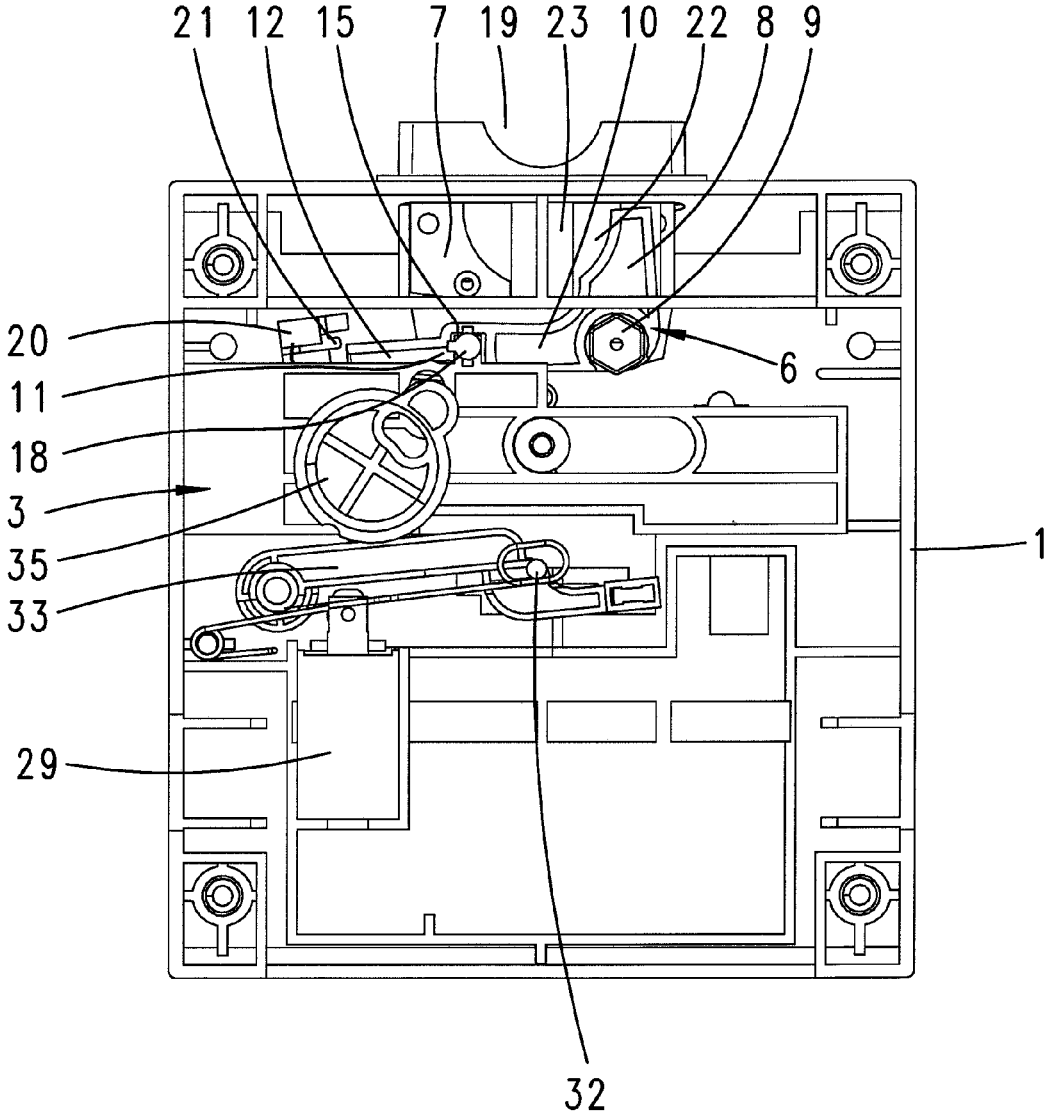
FIG. 4 shows the lock assembly in the housing with the bolt displaced and with no coin inserted.

The container lock shown in the illustrations can be affixed to a container door 25. It comprises a housing 1, which can be affixed to the container door 25 on the inside of the container. The lock comprises a front plate 26, which is affixed on the outside of the door. The front plate 26 comprises a handle 27 by which a crankshaft 35 can be rotated in order to displace a bolt 3 positioned in the housing 1 in a direction that displaces the bolt. The front plate 26 also comprises a scanning field 28 by which a numeric code can be entered.

A transponder reading device can also be installed in the front plate 26 or in the handle 27 in order to read a transponder. In addition, the lock can also be connected with a fingerprint reading device.

The housing 1 consists of a synthetic material. The bolt 3 is preferably of metal construction. Found on the underside of the bolt is a blocking slot 30 that forms two blocking steps 31, 34. A blocking extension 32 of a blocking lever 33 engages in the blocking slot 30. The blocking lever 33 can be rotated by means of an electromagnet 29. Said lever can assume a blocking position, in which, when the bolt is pre-locked, the blocking extension 32 lies in front of the blocking step 31 so that the pre-locked bolt cannot be relocked by the handle 27. As an alternative to the handle actuation, the bolt can also be driven in the bolt withdrawal direction by a tension or compression spring so that it requires only a displacement of the blocking lever 33 from the blocking position into a release position to withdraw the bolt 3 from a bolt forward motion position. In order to pre-lock the bolt, the crankshaft 35, which engages in a recess of the bolt 3, must be rotated. The blocking slot 30 configures an additional blocking step 34. Before this blocking step 34, the blocking extension 32 can lie in the relocked bolt position in order to block the bolt 3 against pre-locking.

An insertion shaft 4 for a coin 5, flanked by shaft walls extending from the narrow end, is located on the narrow end of the housing 1 that points upward in the installed position. The surrounding edge of the insertion shaft 4 runs in an arc in the vicinity of the longitudinal sides of the insertion shaft 4 and configures a convexity 19. Said convexity extends nearly as far as the narrow end of the housing. The convexity 19 is large enough so that a coin 5 inserted in the insertion shaft 4 can be held between two fingers in some areas.

The insertion shaft 4 is configured by two shaft walls 22, 23, so that a rear shaft wall 22 extends over the entire surface of the insertion shaft 4. The front shaft wall 23 extends only over a portion of the width of the insertion shaft 4 and configures a coin insert limiting barrier 24. The coin 5 is in a completely inserted position on this barrier 24, which forms the base of the insertion shaft 4. In this position a portion of the coin 5 lies inside the convexity 19. The apex of the coin extending out of the housing 1 thus lies outside the imaginary insertion shaft edge.

A fixing jaw 8 is affixed to the shaft wall 22. The fixing jaw 8 is affixed to the shaft wall 22 with screws in such a way that it can be displaced.

A stationary fixing jaw 7 is situated opposite the movable fixing jaw 8 perpendicular to the coin insertion direction. Both fixing jaws 7, 8 are capable of partly surrounding the coin 5 in such a way that it is form-locked and thus ensured against withdrawal from the insertion shaft 4. The coin 5 is thus locked inside a range that is less than 180 degrees.

The moveable fixing jaw 8 is connected to an oscillating lever 6. Said oscillating lever 6 is T-shaped in configuration. The two arms of the T configure a bearing arm 10 or a guide groove 12. The base of the T configures the aforementioned moveable fixing jaw 8.

While the fixing jaw 8 is essentially situated parallel to the coin insertion direction and thus extends essentially perpendicular to the bearing arm 10, the bearing arm 10 extends essentially parallel to the displacement direction of the bolt 3. The bearing arm 10 is affixed to the housing or to the shaft wall 22 by means of a rotating axis 9 on its end facing away from the junction of the oscillating lever 6.

An essentially square rib structure is located in the junction of the oscillating lever 6. The ribs 13, 14, 15, 16, and 17 surround an essentially square vacant space that includes a rotation recess 11, and a rotation stud 18 of the bolt 3 engages in said vacant space. The two sections of ribbing 13, 14 that flank the rotation recess 11 configure blocking flanks. The rib structure continues in the displacement direction of the bolt 3 behind the rotation recess 11 and forms a guide groove 12 for the rotation stud 18.

The rotation stud 18 is configured by a square section of the bolt 3, which extends over the back side of the bolt 3. A round stud extends beyond the front side of the bolt 3 on the corresponding spot. The rotation stud 18 is situated on the opposite side of the blocking slot 30 and is connected with an extension of the bolt 3.

A blocking member 20 is positioned before the opening of the guide groove 12 in the housing 1. Said member can be displaced with a needle-shaped tool 37 that is inserted into a housing opening 36. It can be affixed rigidly in place with a screw that is not illustrated. The blocking element 20 comprises a blocking stud 21, which can be inserted into the guide groove 12 in order to fix the oscillating lever 6 in a position in which the rotation recess 11 is situated in the path of movement of the rotation stud 18. In this position, the bolt can be moved even when no coin 5 is inserted. If the blocking element 20 is not blocked in its blocking position by a screw or the like, then the rotation stud 18, when the bolt 3 is completely pre-locked, can force the blocking stud 21 out of the guide groove 12 again.

The oscillating lever 6 is spring-powered by a tension or compression spring, not illustrated, in such a way that when no coin 5 is inserted the rotation stud 18 is situated in front of the upper blocking flank 13. This corresponds to a rotation position of the oscillating lever 6 in which the moveable fixing jaw 8 assumes a position that is most closely situated to the stationary fixing jaw 7. In this position the bolt 3 cannot be pre-closed because the rotation stud 18 cannot enter the rotation recess 11, but instead runs into the blocking flank 13 when the bolt 3 is to be slid.

To be able to close the lock, a coin 5 must first be inserted into the insertion shaft 4. The coin 5 here is completely inserted into the insertion shaft 4 until it is in contact with the base of the shaft 24. In this position, a sufficiently large portion of the coin 5 still lies outside the insertion shaft 4 or inside the convexity 19, so that the coin 5 can be withdrawn again from the insertion shaft 4 by gripping it with two fingers.

In the course of inserting the coin 5 into the insertion shaft 4, the two fixing jaws 7, 8 are first drawn apart from one another by moving the moveable fixing jaw 8 and then brought slightly closer together until the coin 5 is form-locked and so held in place by being partially surrounded. If the coin 5 has the correct diameter, then the rotation recess 11 is situated in the path of movement of the rotation stud 18. With the blocking lever 33 released, the bolt 3 can be pre-closed by actuation of the handle 27. In this process the rotation stud 18 descends through the rotation recess 11 and moves into the guide groove 12 that is flanked by two ribs. As soon as the rotation stud 18 has descended into the guide groove 12, the oscillating lever 6 can no longer be rotated. The coin 5 is thus blocked in the insertion shaft 4 between the two fixing jaws 7, 8. The bolt 3 can be pre-locked until it is in its end position, in which the blocking extension 32 moves behind the blocking step 31 and can thus fix the bolt 3 in the front position. The bolt is withdrawn preferably by means of a tension spring, which is not shown, as described in DE 198 32 516 A1.

If a coin 5 with a smaller diameter is inserted into the insertion shaft 4, then when the coin 5 is inserted the rotation stud 18 is situated in front of the blocking flank 13. The sliding of the bolt is blocked. If a coin 5 with too great a diameter is inserted into the insertion shaft 4, then when the coin is completely inserted the rotation stud 18 is situated in front of the lower blocking flank 14. In this position as well, the bolt 3 cannot be displaced.

Figure 5:
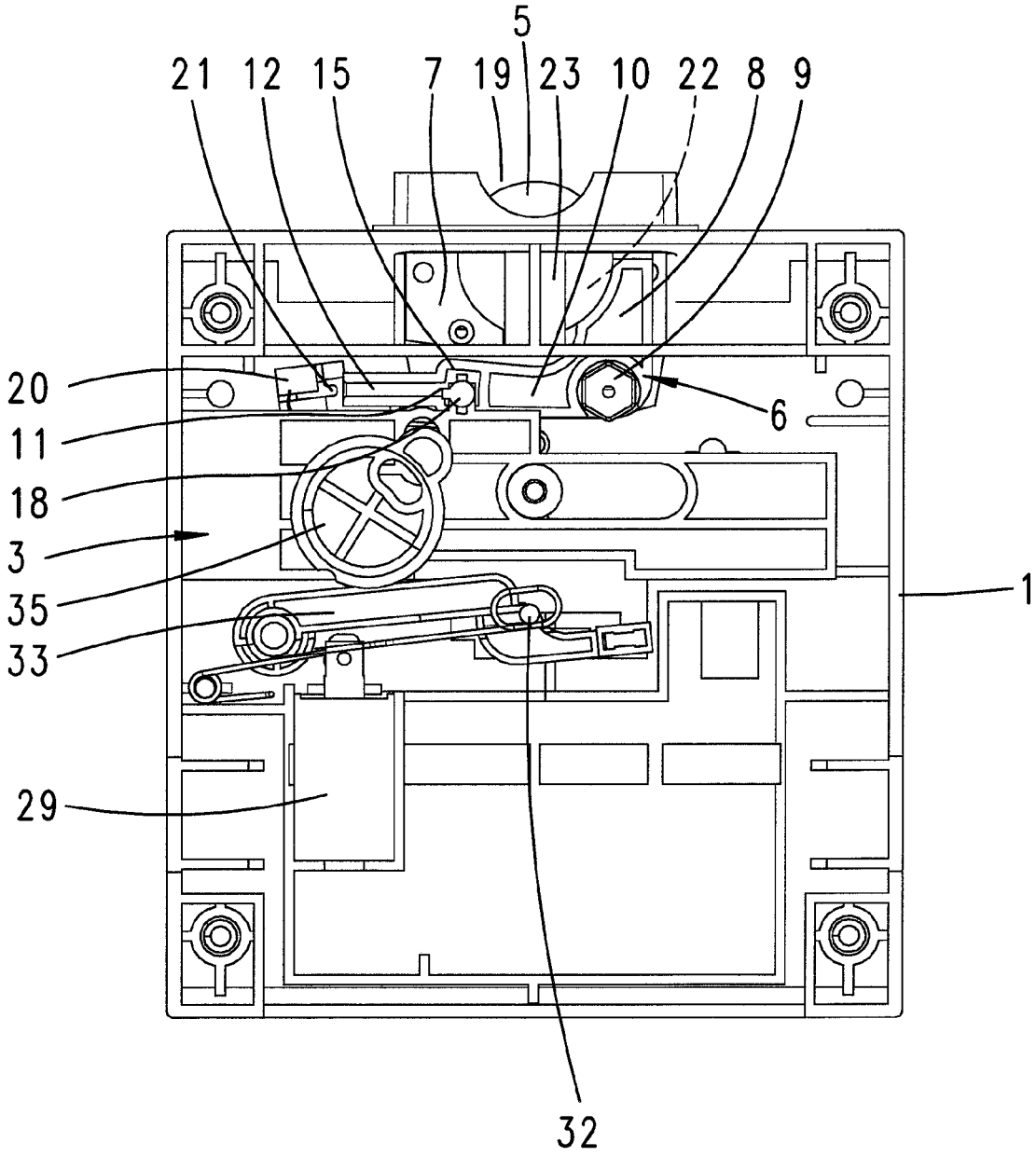
FIG. 5 shows a depiction as in FIG. 4 with an appropriate coin inserted.
Figure 6:
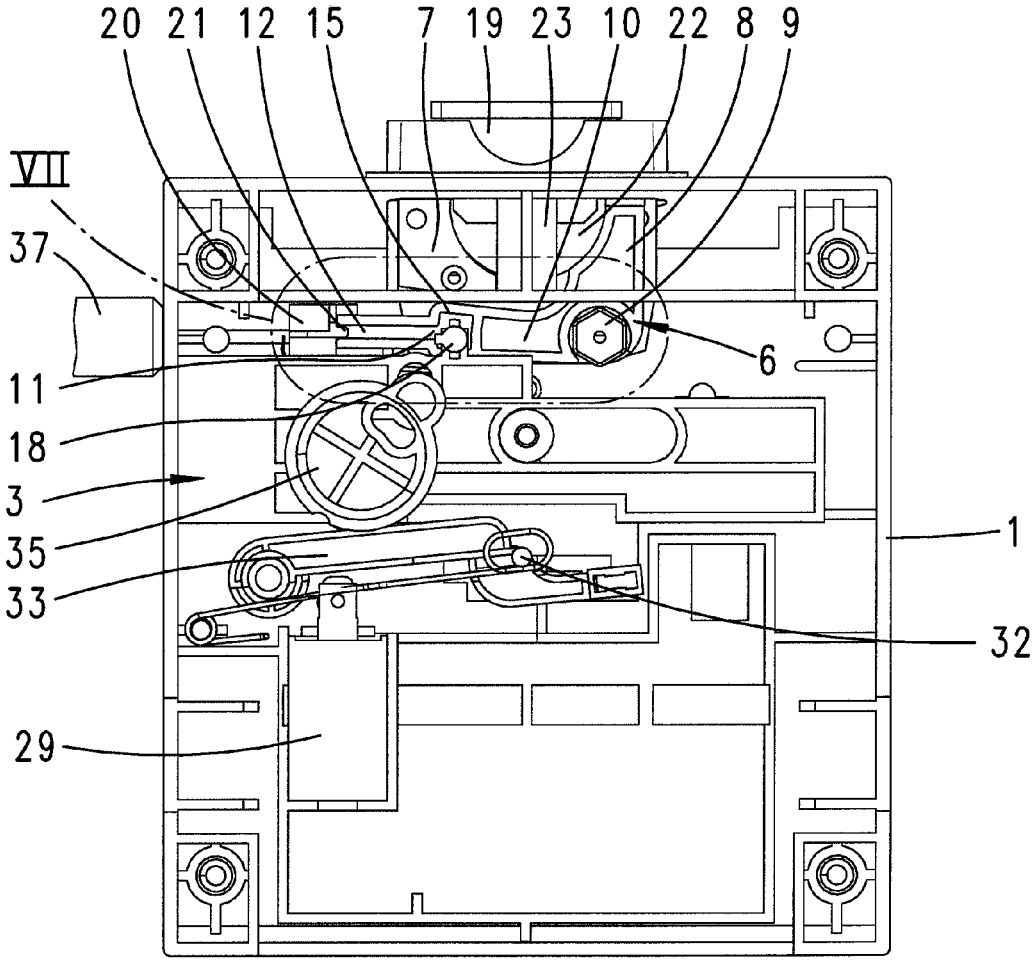
FIG. 6 shows a depiction as in FIG. 4 with the blocking element activated.
Figure 7:
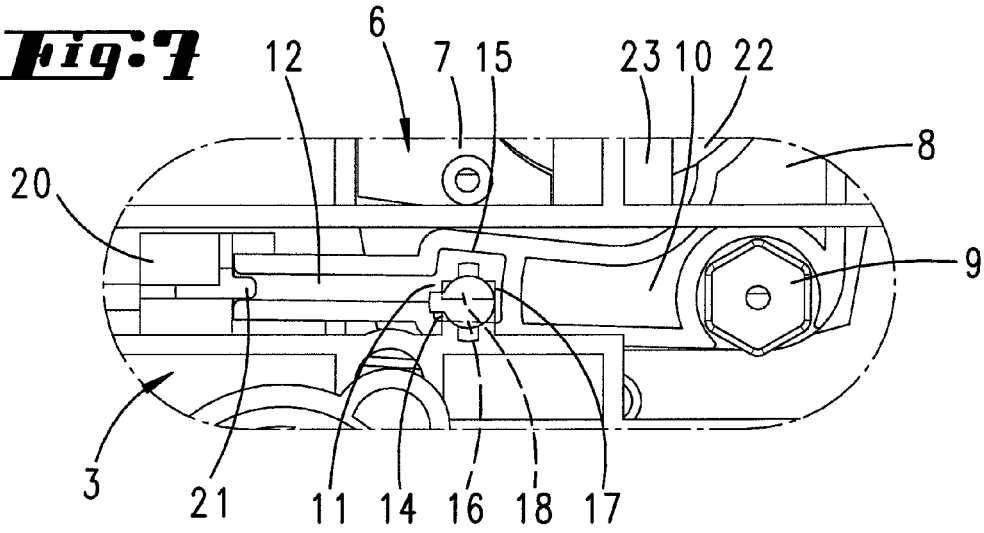
FIG. 7 shows an enlarged view of detail VII of FIG. 6.
Figure 8:
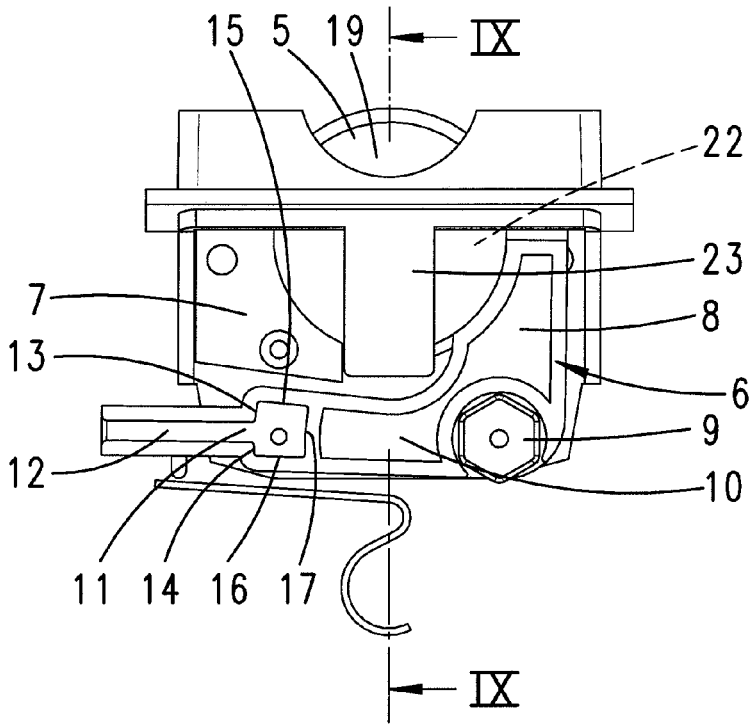
FIG. 8 shows an individual view of the scanning device.
Figure 9:
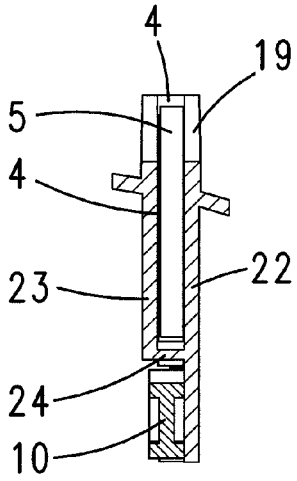
FIG. 9 shows a section along the line IX-IX.
Figure 10:
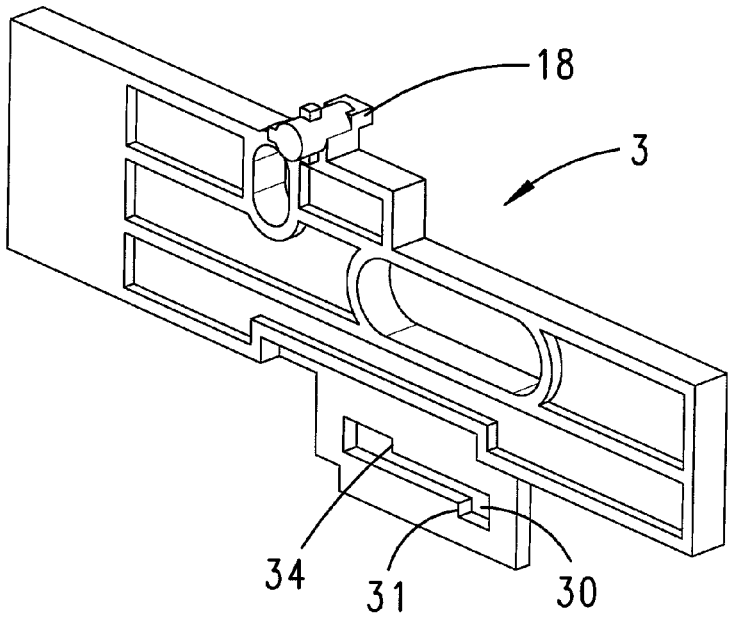
FIG. 10 shows the bolt in a perspective view.

The fixing jaw 8 comprises an aperture for screwing in a screw. If a screw is screwed into this aperture, then the rotatability of the oscillating lever 6 is blocked. The screw-in aperture in the fixing jaw 8 is preferably flush with a threaded aperture in the shaft wall 23. The threaded aperture is positioned in such a way that in the screwed-in position the oscillating lever assumes the position shown in FIG. 5, in which the rotation stud 18 is situated in front of the rotation recess 11, so that the bolt 3 can be pre-closed. With this type of permanently fixed oscillating lever 6, the lock can be used as a container lock without deposit function.

In an embodiment that is not illustrated, the sensing device 7, 8 comprises a sensor or a micro-switch. The sensor can be actuated by the oscillating lever. The sensor is preferably configured in such a way that it closes an electrical circuit if the oscillating lever assumes its rotation position shown in FIG. 5, which corresponds to the rotation position with a correct coin 5 inserted. In all other rotation positions, that is with no coin inserted or with a coin that is too large or too small inserted, the electrical circuit is not closed. The displacement blocking of the bolt 3 is then exerted, preferably electromagnetically, for instance by the electro magnet 29. Said electro magnet can move the blocking extension 32 into the release position only when the electrical circuit of the electric sensing device is closed. Alternatively, it is also possible that an otherwise closed electrical circuit is opened when a correct coin is inserted.

In an additional embodiment that is not shown, a switching vane of a scanner or of a switch immediately scans the coin and thus delivers an electrical scanning signal.

All disclosed characteristics are (in themselves) essential to the invention. The disclosure of the application hereby also includes the disclosure content of the related/added priority documents (copy of the pre-application) in its full content, also for the purpose of including characteristics of these documents in claims of the present invention.

The invention claimed is:

1. A container lock comprising:

a housing;

a bolt positioned in said housing that can be displaced by actuating a handle;

an insertion shaft for inserting a coin; and a scanning device for scanning the diameter of the coin inserted into the insertion shaft as far as a scanning position, where the scanning device interacts with a blocking device in such a way that the bolt can be displaced only with a coin having a correct diameter, the scanning device configures a fixing jaw, which securely grips the coin that is inserted in the insertion shaft so that it is partly accessible from outside in the scanning position with the bolt pre-locked to prevent its withdrawal.

2. The container lock according to claim 1, wherein the fixing jaw is configured by an oscillating lever that is mounted so that it can rotate around an axle securely fixed to the housing.

3. The container lock according to claim 2, wherein the oscillating lever configures a bearing arm on whose end the axle is positioned and from which the fixing jaw extends essentially perpendicularly.

4. The container lock according to claim 1, wherein the fixing jaw configures a rotation recess flanked by at least one blocking flank for inserting a rotating pin connected to the bolt.

5. The container lock according to claim 3, wherein the bearing arm and a guide groove connected to the rotation recess extends essentially parallel to the bolt displacement direction.

6. The container lock according to claim 1, characterized by a stationary fixing jaw opposite the fixing jaw.

7. The container lock according to claim 6, wherein the distance between the fixing jaw and the stationary fixing jaw can be adjusted by a change in location of the stationary fixing jaw.

8. The container lock according to claim 1, wherein the insertion shaft comprises a convexity in which a portion of the inserted coin is situated.

9. The container lock according to claim 1, characterized by a secondary blocking device that holds the bolt firm against a bolt displacement in a pre-closed bolt position independently of the blocking device and that can be released by a release device.

10. The container lock according to claim 9, wherein the release device releases the blocking device only after a secret code is entered.

11. The container lock according to claim 10, wherein the secret code can be conveyed by a transponder call-up device, a touch screen device, a cylinder lock, or a keyboard.

12. The container lock according to claim 1, wherein the container lock can be opened by a fine function, the coin removed, and the container lock reclosed, bypassing the scanning function, with the help of an overriding secret code.

13. The container lock according to claim 1, characterized by an auxiliary tool with which the scanning device can be moved into a position corresponding to a coin inserted in the insertion shaft, and with a blocking element that blocks the scanning device in a position that can move the bolt.

14. The container lock according to claim 13, characterized by a blocking stud that is configured by the blocking element and that can engage in a guide groove of the oscillating lever in order to block the oscillating lever in a rotation position, in which the bolt can be pre-locked.

15. The container lock according to claim 2, wherein the oscillating lever can be fixed in place by a screw.

16. The container lock according to claim 1, characterized by a switch or scanner connected to the scanning device for providing an electric signal with which the displacement movement of the lock can be blocked when no coin is inserted or when an inappropriate coin is inserted.

* * * * *